United States Patent [19]

Longrod et al.

[11] 4,364,679

[45] Dec. 21, 1982

[54] CARTRIDGE RIBBON LIFT APPARATUS

[75] Inventors: Scott J. Longrod, Danbury, Conn.; Francis R. Oakley, Cortland, N.Y.

[73] Assignee: SCM Corporation, New York, N.Y.

[21] Appl. No.: 235,201

[22] Filed: Feb. 17, 1981

[51] Int. Cl.[3] ..... B41J 35/10

[52] U.S. Cl. ..... 400/212; 400/215.3

[58] Field of Search ..... 400/211–213.1, 400/216.2, 216, 215–215.3

[56] References Cited

U.S. PATENT DOCUMENTS

| | | | |
|---|---|---|---|
| 3,100,560 | 8/1963 | Kondur, Jr. | 400/212 |
| 3,741,364 | 6/1973 | Becker | 400/212 |
| 3,861,510 | 1/1975 | Wilczewski et al. | 400/124 |
| 3,880,271 | 4/1975 | Hebron | 400/212 |
| 3,891,078 | 6/1975 | Jung | 400/212 |
| 3,995,547 | 12/1976 | Shirodaira | 400/212 |
| 3,995,731 | 12/1976 | Miller et al. | 400/229 |
| 4,008,662 | 2/1977 | Sato | 400/213 |
| 4,084,503 | 4/1978 | Pylant et al. | 400/196.1 |
| 4,280,767 | 7/1981 | Heath | 400/213 |

FOREIGN PATENT DOCUMENTS

| | | | |
|---|---|---|---|
| 2,057,976 | 4/1981 | United Kingdom | 400/212 |

*Primary Examiner*—William Pieprz

*Attorney, Agent, or Firm*—Kenneth W. Greb; Ernest F. Weinberger

[57] ABSTRACT

A cartridge ribbon lift apparatus is provided in which a pivotally mounted cartridge, containing a ribbon, is pivoted upward to a printing position by a linkage which is operated by a solenoid. When the cartridge reaches the printing position a second linkage latches the cartridge in the printing position for repeat and burst speed printing and the cartridge remains in the printing position as long as the solenoid remains energized. While the cartridge is latched in the printing position the first linkage is restored to its initial operating position.

12 Claims, 2 Drawing Figures

CARTRIDGE RIBBON LIFT APPARATUS

BACKGROUND OF THE INVENTION

The development of the cartridge ribbon in which the ribbon supply reel and take-up reel are contained within a cartridge has eliminated the need for a user to carefully thread the ribbon through the various guide members of a conventional typewriter. However, the use of the cartridge ribbon has resulted in a need for a simple and efficient means for lifting the cartridge ribbon from a lower position, in which the printed characters can be viewed to a raised, or printing position, in which the characters are formed. The dynamic problems faced by a cartridge ribbon lift apparatus are more complex than those faced by the conventional ribbon lift apparatus of a conventional typewriter due to the greater mass and greater inertia of the cartridge ribbon as compared with the relatively small segment of conventional ribbon which is raised and lowered in a conventional typewriter. In addition, there is a need for a simple and efficient means for maintaining the cartridge ribbon in the printing position for periods of repeat printing and rapid burst typing.

The prior art related to electric typewriters includes various examples of devices for raising and lowering typewriter ribbon elements. Examples of such devices may be found in U.S. Pat. No. 890,037 to J. Felbel, U.S. Pat. No. 1,889,315 to E. H. Henderson, and U.S. Pat. No. 4,053,043 to D. R. Deetz. U.S. Pat. No. 890,037 shows a ribbon lift device which includes a latch which raises a vibratory ribbon carrier to locate a selected portion of the ribbon in a printing position for repeat printing. U.S. Pat. No. 1,889,315 shows a ribbon lift device in which a solenoid remains energized during a repeat printing operation to hold a ribbon carrier in a printing position. U.S. Pat. No. 4,053,043 shows a ribbon lift device which includes an electronic latch circuit for holding a ribbon cartridge in a printing position for repeat printing.

Each of the above ribbon lift devices is characterized by the use of a relatively large number of component parts resulting in a relatively high overall level of complexity. This results in a relatively high manufacturing cost due to the need for careful manufacture of the various component parts, complex and costly assembly procedures, a need for careful adjustment and a need for costly assembly procedures.

OBJECTS OF THE INVENTION

It is an object of the present invention to overcome the disadvantages of the prior art by providing a cartridge ribbon lift apparatus which can quickly move a cartridge containing a ribbon from a lower position to an upper or printing position.

Another object of the present invention is to provide a cartridge ribbon lift apparatus capable of being latched in a raised position for repeat printing.

Another object of the present invention is to provide a cartridge ribbon lift apparatus which does not require either complex assembly or adjustment techniques.

Still another object of the present invention is to provide a cartridge ribbon lift apparatus which requires relatively few component parts which are economical of manufacture, resulting in a relatively low overall cost.

SUMMARY OF THE INVENTION

In accordance with the present invention there is provided a cartridge lift apparatus which includes a pivotally mounted cartridge holder which supports a cartridge which contains a printing ribbon. The apparatus operates to pivot the cartridge holder from a lower position, in which the cartridge holder and the cartridge are substantially horizontal, to an upper position, in which the printing ribbon is disposed adjacent to a platen thereby enabling impact printing elements to strike the ribbon and form characters on paper or other media which is supported by the platen. The apparatus is operated by the energization of a solenoid which pivots a bellcrank causing an arm of the bellcrank to actuate a positive drive clutch mechanism which enables a drive cam to be rotated by a stepper motor. The surface of the drive cam includes a plurality of lobes which cause a cam follower to pivot and force a pin mounted on the cam follower to bear against a pin mounted on the cartridge holder thereby forcing the cartridge holder to pivot upward. As the cartridge holder moves upward, a latch member engages a second arm of the bellcrank and the cartridge is latched into the printing position for as long as the solenoid remains energized. While the cartridge is latched in the printing position, the cam follower is restored to its initial operating position ready for the next printing stroke.

BRIEF DESCRIPTION OF THE DRAWINGS

Additional objects and advantages of the present invention will become apparent during the course of the following specification when taken in connection with the accompanying drawings in which.

DESCRIPTION OF THE PREFERRED EMBODIMENT

Figure 1:
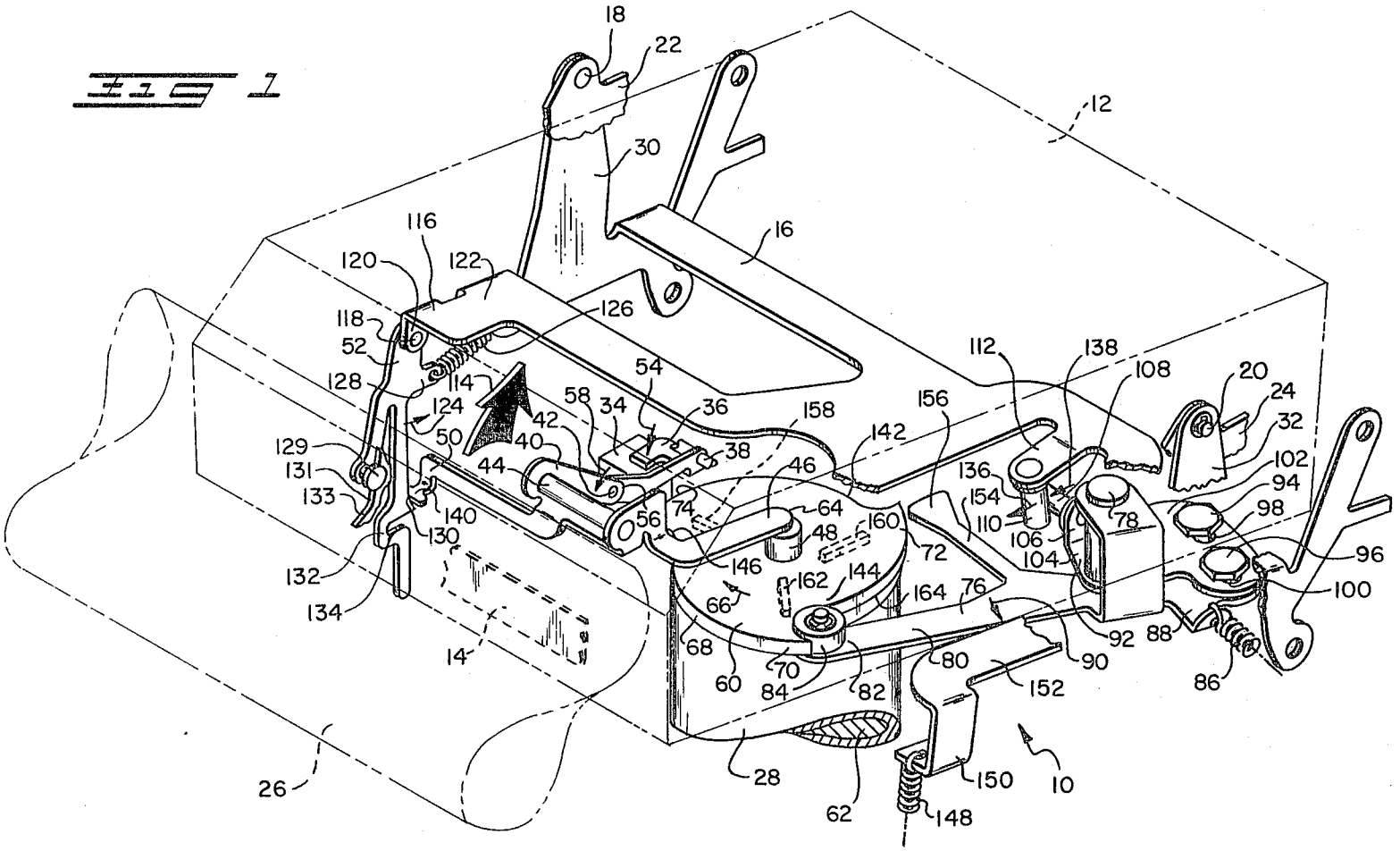
FIG. 1 is an overall perspective view of a cartridge ribbon lift apparatus according to the present invention with the cartridge member shown in broken lines and with portions of the apparatus shown broken away to reveal internal details of construction.
Figure 2:
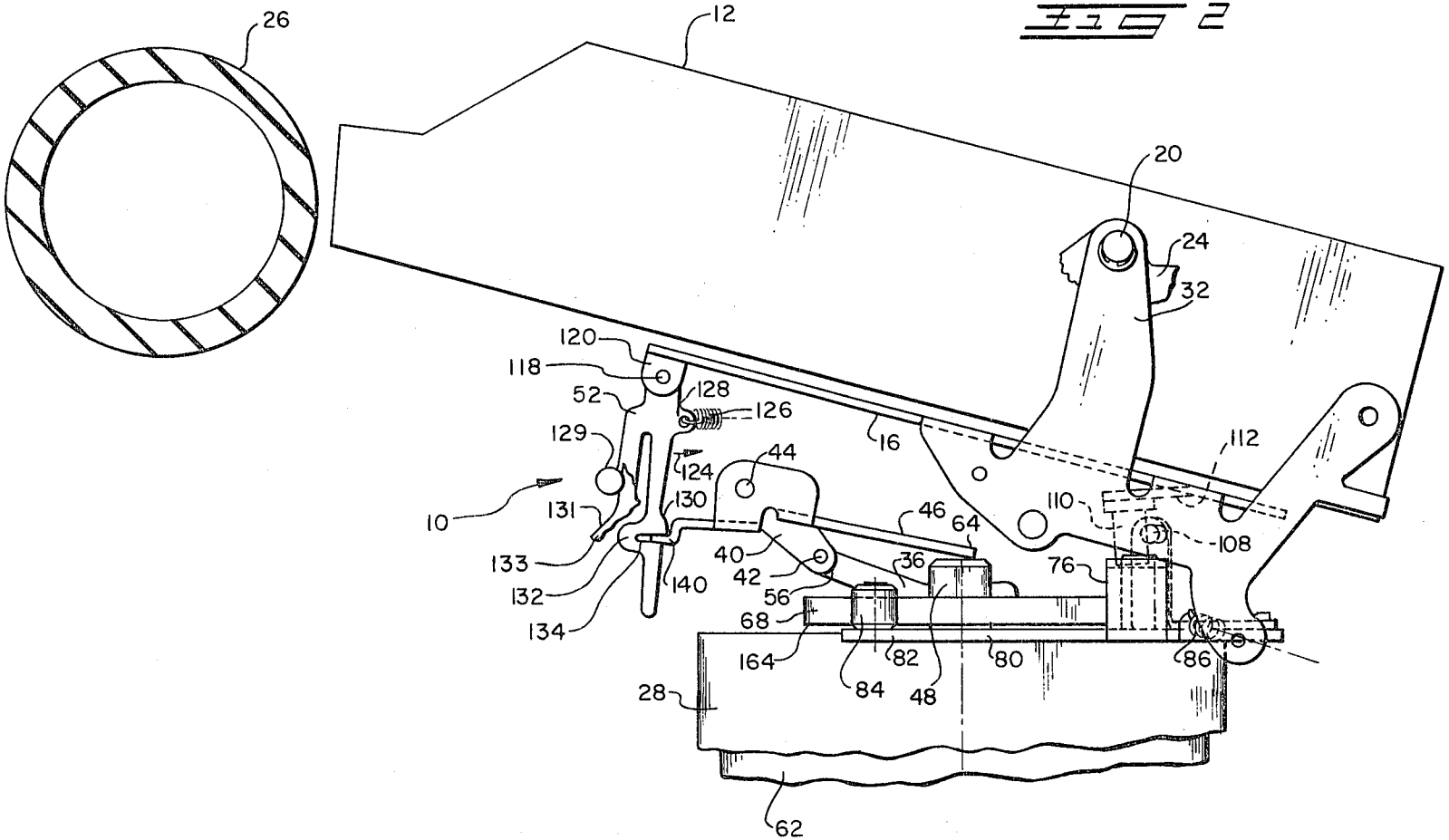
FIG. 2 is a side elevation view of the cartridge ribbon lift apparatus of FIG. 1, with the apparatus shown mounted on the carrier of a typewriter and showing the cartridge member in the raised position, adjacent to a platen member, which is shown in section.

With reference to the drawings, there is shown in FIG. 1 a cartridge ribbon lift apparatus 10, in accordance with the present invention with the cartridge member 12, which contains the ribbon 14, shown in broken lines. The apparatus 10 operates to pivot the cartridge holder 16, which supports the cartridge member 12 about the pivots 18, 20 which are mounted on the fixed brackets 22, 24 from a lower position, in which the cartridge holder 16 is substantially horizontal to a lifted position, which is shown in FIG. 2. In the raised, or lifted position, the cartridge member 12 is disposed proximate to the platen member 26, thereby enabling type elements, which are conventional in nature and are not shown, to impact the ribbon 14, carried by the cartridge member 12, thereby forming characters on paper or other suitable media which is supported by the platen member 26. The fixed brackets 22, 24 are supported by the typewriter carrier 28, which is shown in FIG. 2 and the fixed brackets 22, 24 are connected to the sides 30, 32 of the cartridge holder 16 by the pivots 18, 20.

The apparatus 10 includes a solenoid 34 which has a pivotally mounted actuator arm 36 which is supported by the pivot shaft 38 and which is pivotally connected to the bellcrank member 40 by the pivot 42. The bellcrank member 40 is supported by the pivot shaft 44 and has a first arm 46 which extends proximate to a positive drive clutch mechanism 48 and a second arm 50 which extends proximate to a latch member 52, which will be described presently. The solenoid 34 is energized by a circuit, which is conventional in nature and is not shown, and energization of the solenoid 34 causes the activator arm 36 to move downward, in the direction shown by the arrow 54 in FIG. 1 and the actuator arm 36 causes the end 56 of the bellcrank member 40 to also move downward, in the direction shown by the arrow 58 in FIG. 1. This downward motion of the end 56 of the bellcrank member 40 causes the first arm 46 to also move downward and thereby operate the positive drive clutch mechanism 48. The positive drive clutch mechanism 48 operates to couple a lift drive cam 60 to a carrier advance stepper motor 62. Both the clutch mechanism 48 and the stepper motor 62 are disposed directly below the end 64 of the first arm 46 of the bellcrank member 40.

The lift drive cam 60 is rotated by the stepper motor 62 in a clockwise direction when viewed from above, as indicated by the arrow 66 in FIG. 1. The lift drive cam 60 has a profile surface 68 which includes three lobes 70, 72, 74. The stepper motor 62 is also connected to the typewriter carrier 28 by mechanical connections which are not shown. The stepper motor 62 is disposed to operate in increments of one-third of a full revolution because this is the amount of motion required to character space the typewriter carrier 28, hence the three lobe profile surface 68 on the lift drive cam 60.

A cam follower member 76 is pivotally mounted, by means of a pivot 78, and includes a first arm 80 on the end 82 of which there is mounted a roller 84. The roller 84 is urged into contact with the profile surface 68 of the lift drive cam 60 by the tension spring 86, which is connected to the portion 88 of the cam follower member 76. As the lift drive cam 60 is rotated in the direction shown by the arrow 66 the end 82 of the cam follower member 76 pivots outwardly in a counter-clockwise direction, when viewed from above, in the direction shown by the arrow 90. An adjustable lift bracket 92 is mounted on the cam follower member 76 by means of the pivot 78 and the adjustment screws 94, 96. The adjustment screws 94, 96 pass through slots 98, 100, respectively, in the base 102 of the adjustable lift bracket 92 and once the adjustment screws 94, 96 are tightened, the adjustable lift bracket 92 pivots with the cam follower member 76. The end 104 of the adjustable lift bracket 92 includes a vertical portion 106 on which there is mounted a pin 108 which projects in a generally horizontal direction. The pin 108 abuts a downwardly projecting pin 110 which is mounted on the arm 112 of the cartridge holder 16. The pins 108, 110 enable the cartridge holder 16 to be pivoted upward in the direction shown by the arrow 114 in FIG. 1, to the position shown in FIG. 2, and thereby lifting the ribbon 14 to a position adjacent to the platen member 26 and enabling the ribbon 14 to print onto paper or other suitable media supported by the platen member 26.

The latch member 52 is pivotally connected to an arm 116 of the cartridge holder 16 by means of a pivot 118 which is mounted on a tab 120 which is formed on the forward portion 122 of the arm 116. The latch member 52 is biased toward the cartridge holder 16, in the direction shown by the arrow 124 in FIGS. 1 and 2, by means of the tension spring 126 which is connected to the tab 128 on the latch member 52 and the side 30 of the cartridge holder 16. A pin 129 with an enlarged head on the latch member 52 is biased against an edge 131 of a rigid guide member 133 by the spring 126 to control the pivotal movement of the latch member 52. The latch member 52 includes a cam surface 130 which is disposed directly above a portion 132 which includes a slot 134. When the cartridge holder 16 is raised by the combined action of the pins, 108, 110 which move in the directions shown by the arrows 136, 138 in the manner which has been previously described, the latch member 52 is lifted and simultaneously pivots counter-clockwise as the pin 129 follows the edge 131 until the cam surface 130 is cammed past a tab 140 on the arm 50. When the cam surface 130 passes the tab 140, the tab 140 enters the slot 134 as is shown in FIG. 2. The engagement of the tab 140 within the slot 134 prevents the cartridge holder 16 from falling even when a low portion 142, 144, 146 of the lift drive cam 60 is rotated into alignment with the roller 84. The ribbon 14 remains in the lift position so long as the solenoid 34 is energized. The solenoid 34 remains energized for a period which is sufficient to allow printing. The solenoid 34 also remains energized throughout repeat printing and rapid burst typing thereby avoiding continual flopping of the cartridge member 12.

The cartridge member 12 is lowered when the solenoid 34 is de-energized and the tab 140 is withdrawn from engagement with the slot 134. The tension spring 148 which is connected to the downwardly projecting portion 150 of the arm 152 of the cartridge holder 16 aids in lowering the cartridge holder 16 thereby causing the latch member 52 to pivot clockwise by the pin 129 following the edge 131 and thereby bringing the pin 110 back against pin 108.

To prevent the lift drive cam 60 from over-throwing its one-third of a revolution, an arm 154 extends from the cam follower member 76 and the end 156 of the arm pivots beneath the lift drive cam 60 to engage one of three abutment stops which are indicated by the broken lines 158, 160, 162 in FIG. 1 and which are molded on the lower surface 164 of the drive lift cam 60.

While a preferred embodiment of the invention has been shown and described herein, it is obvious that numerous additions, changes and omissions may be made in such embodiments without departing from the spirit and scope of the invention.

I claim:

1. A ribbon lift apparatus for an electric printing device comprising:

a ribbon support member operable for movement between a raised position for locating a ribbon in printing position and a lowered position for viewing printing characters;

a lift linkage operable from a first position to a second position to raise said ribbon support member from said lowered position to said raised position and operable to return to said first position;

a drive means including a cam cyclincally operable for actuating said lift linkage to said second position and for allowing said lift linkage to return to said first position;

electrical transducer means operatively connected to said drive means to cause said drive means to actuate said lift linkage; and a latch means responsive to operation of said electrical transducer means to latch said ribbon support member in said raised position for a sufficient period to allow printing while said lift linkage returns to said first position, said latch means responsive to deactivation of said electrical transducer means to unlatch said ribbon support member to allow said ribbon support member to return to said lowered position.

2. The ribbon lift apparatus as defined in claim 1 wherein said drive means comprises:

a drive motor; and a clutch mechanism for coupling said drive motor to said cam.

3. The ribbon lift apparatus as defined in claim 2 wherein said drive motor is a stepper motor.

4. The ribbon lift apparatus as defined in claim 2 wherein said latch means includes a latch member and further comprising an actuation linkage including a bellcrank member operable for actuating said clutch mechanism to couple said drive motor to said lift linkage and operable to engage said latch member to latch said ribbon support member in said raised position.

5. The ribbon lift apparatus as defined in claim 2 wherein said lift linkage includes a cam follower driven by said cam from an unactuated position to an actuated position to raise said ribbon support member to said raised position, and a spring for returning said cam follower to said unactuated position while said latch means latches said ribbon support member in said raised position.

6. The ribbon lift apparatus as defined in claim 1 wherein said latch means further comprises:

a latch member pivotally connected to said ribbon support member;

means for pivoting said latch member to a latching position in response to movement of said ribbon support member to said raised position;

an arm actuated by said electrical transducer means for engaging said latch member while in said latching position for latching said ribbon support member in said raised position.

7. The ribbon lift apparatus as defined in claim 6 wherein said latch member has a slot and wherein said arm has a tab for entering said slot for latching said ribbon support member in said raised position.

8. The ribbon lift apparatus as defined in claim 1 wherein said ribbon support member has a first pin mounted thereon and wherein said lift linkage includes a second pin, said second pin engages said first pin to raise said ribbon support member to said raised position when said lift linkage moves from said first position to said second position, and said second pin disengages said first pin when said latch means latches said ribbon support member in said raised position and said lift linkage returns to said first position.

9. The ribbon lift apparatus as defined in claim 8 wherein said lift linkage includes means for adjusting said second pin relative to said first pin for adjusting the height of said raised position of said ribbon support member.

10. The ribbon lift apparatus as defined in claim 1 wherein said ribbon support member has a spring connected thereto for biasing said ribbon support member to said lowered position when released from said latch means.

11. The ribbon lift apparatus as defined in claim 1 wherein said electrical transducer means comprises a solenoid.

12. A ribbon lift apparatus as defined in claim 1 wherein said ribbon support member supports a ribbon supply cartridge for moving the ribbon between said raised position for printing and said lowered position for viewing printed characters.

* * * * *